US005391060A

United States Patent [19]

Kozumplik, Jr. et al.

[11] Patent Number: 5,391,060

[45] Date of Patent: Feb. 21, 1995

[54] AIR OPERATED DOUBLE DIAPHRAGM PUMP

[75] Inventors: Nicholas Kozumplik, Jr.; Gerald M. Distel, both of Bryan, Ohio

[73] Assignee: The Aro Corporation, Bryan, Ohio

[21] Appl. No.: 61,883

[22] Filed: May 14, 1993

[51] Int. Cl.[6] ..... F04B 43/06

[52] U.S. Cl. ..... 417/393; 417/389; 91/309; 91/329

[58] Field of Search ..... 417/395, 393, 389; 91/309, 313, 329

[56] References Cited

U.S. PATENT DOCUMENTS

| | | | |
|---|---|---|---|
| 4,008,984 | 2/1977 | Scholle | 417/393 |
| 4,019,838 | 4/1977 | Fluck | 417/393 |
| 4,386,888 | 6/1983 | Verley | 417/393 |
| 4,540,349 | 9/1985 | Du | 417/393 |
| 4,549,467 | 10/1985 | Wilden | 417/393 |
| 4,597,721 | 7/1986 | Santefort | 417/393 |
| 4,682,937 | 7/1987 | Credle | 417/393 |
| 5,108,270 | 4/1992 | Kozumplik | 417/393 |
| 5,195,878 | 3/1993 | Sahiavo et al. | 413/393 |
| 5,213,485 | 5/1993 | Wilden | 417/393 |
| 5,240,390 | 8/1983 | Kvinge et al. | 417/393 |

*Primary Examiner*—Richard A. Bertsch
*Assistant Examiner*—Peter Korytnyk
*Attorney, Agent, or Firm*—Walter C. Vliet

[57] ABSTRACT

The design of an air operated double diaphragm pump provides improved assembly, mounting flexibility, multiple plumbing combination including check valves which allow the pump to be mounted in any position without effecting its ability to prime or pump. A two shell housing design provides an enclosure for the air motor and includes structural ribbing, internal baffling, and all connections are made on the end of the pump in line with the diaphragm centerline allowing the pump to be installed in any access in line with the plumbing system.

7 Claims, 5 Drawing Sheets

AIR OPERATED DOUBLE DIAPHRAGM PUMP

BACKGROUND OF THE INVENTION

This invention relates generally to diaphragm pumps and more particularly to the design for manufacture and assembly of a new double diaphragm pump assembly.

In the past, assembly of such diaphragm pumps required assembly of the numerous components about a base requiring appropriate assembly and orientation of both the parts and the base during assembly. The chances for part misorientation and/or assembly from difficult positions and/or the constant manipulation of the entire then assembled pump was required. Mounting options and position of supply and output lines required knowledge of preassembly or reassembly of the parts at a later point of application. External manifolding presented numerous possibilities for damage of externally supported components and the proper tightening of a relatively large number of individual fasteners.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an air operated double diaphragm pump comprising a substantially cylindrical transverse split shell; end cover plates disposed at each end of the shell; the end plates being further provided with both inlet and outlet pumped fluid connections so as to provide inline piping connection capability; and the pumped fluid connections are selectively interconnected by an internal manifold within the shell.

In another aspect of the present invention this is accomplished by a method of assembly for a double diaphragm pump comprising the steps of assembling in a continuous stack in sequence; a first wet pumping end including inlet and outlet check valves, a first wet end cap, a first diaphragm, a first air cap shell, pressure fluid motor means, a second air cap shell, a second diaphragm, a second wet end cap including means for selectively interconnecting the first inlet and outlet check valves and second inlet and outlet check valves, and the second inlet and outlet check valves.

The foregoing and other aspects will become apparent from the following detailed description of the invention when considered in conjunction with the accompanying drawing figures.

BRIEF DESCRIPTION OF THE DRAWING FIGURES

Figure 4:
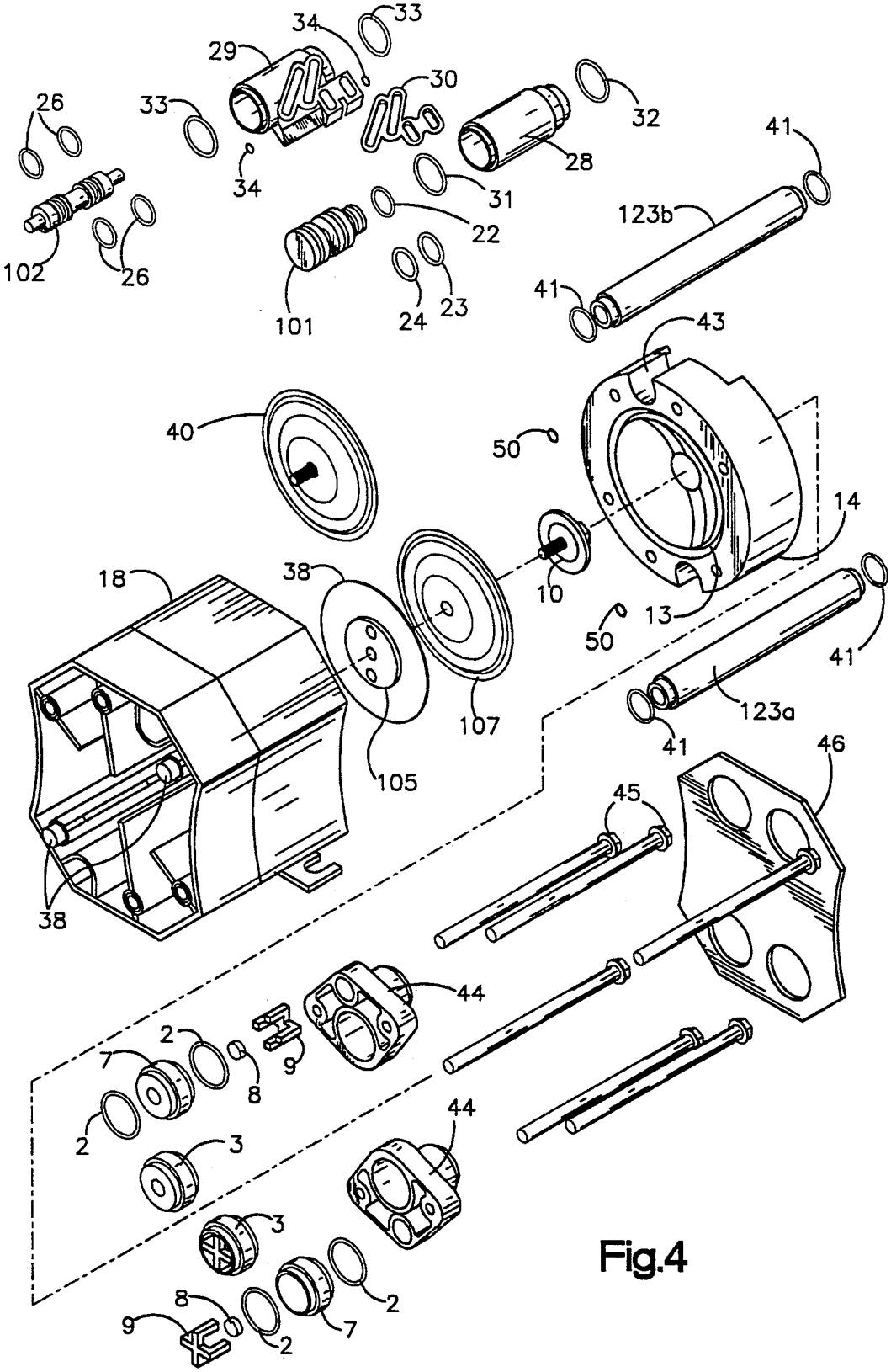
Figure 4A:
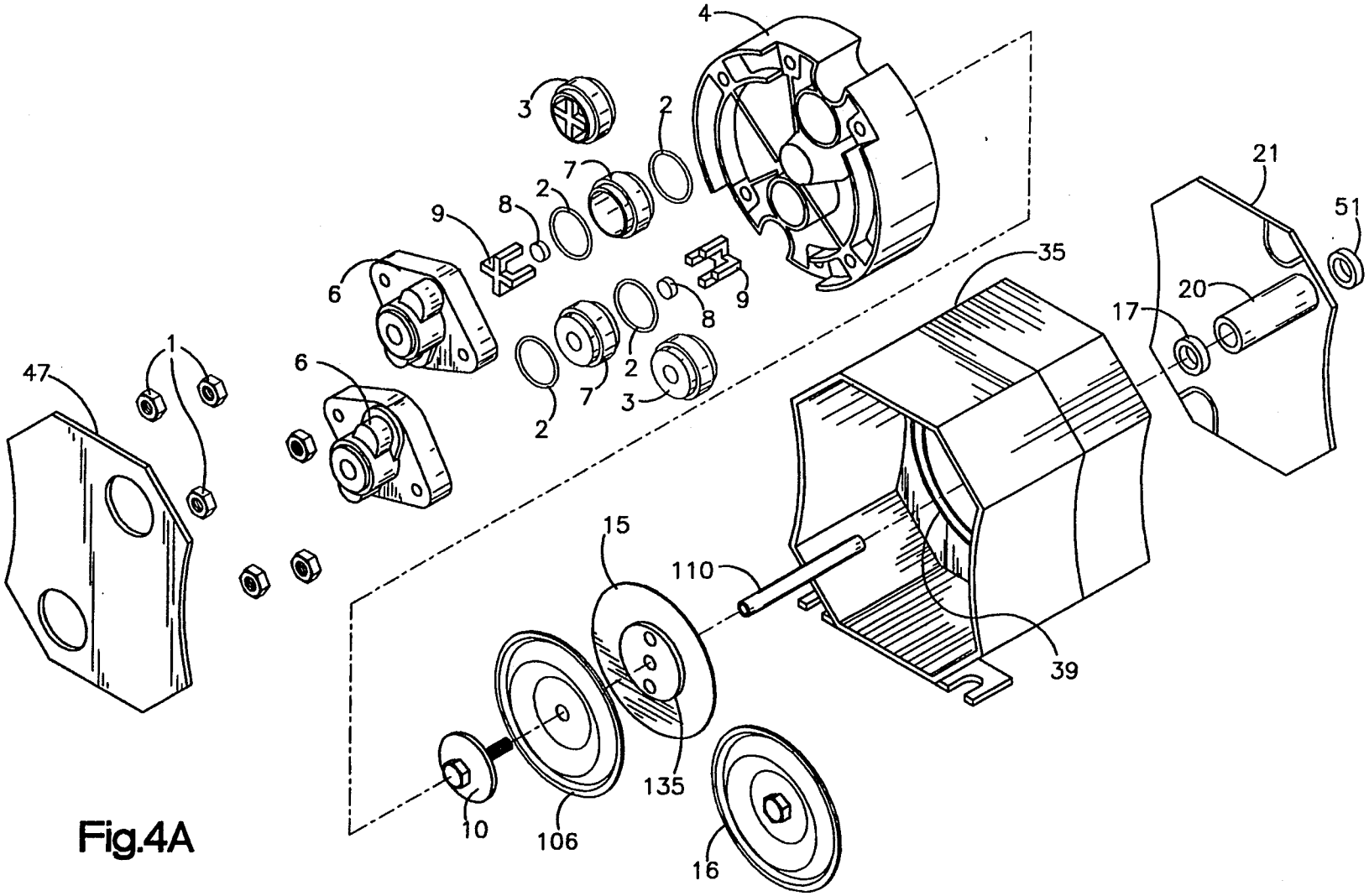
Figure 5:
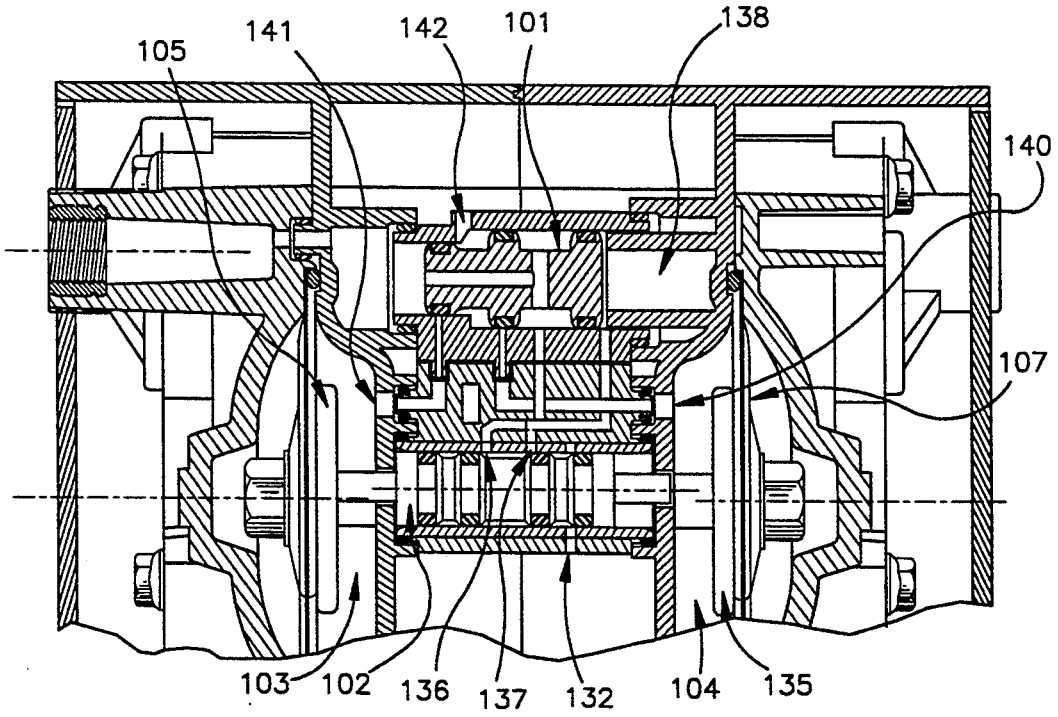

FIGS. 4 and 4*a* are an exploded view of the assembly of a double diaphragm pump according to the present invention; and FIG. 5 is a partial cross section of an air operated double diaphragm pump according to the present invention taken at the longitudinal center of a substantially circular cross section showing the pilot valve in the extreme left hand position.

DETAILED DESCRIPTION

The device shown in FIGS. 1–5 is an air operated double diaphragm pump. Construction is of thermoplastic materials although the pump could be constructed of other materials. The wet ends (contacting pumped material) are constructed of polypropylene for general chemical uses or conductive acetal for applications when pumping flammable materials and solvents. The device incorporates techniques to reduce assembly time and eliminate assembly errors. The design also reduces the number of parts as well as providing unique features such as mounting flexibility and multiple plumbing combinations. The check valves allow the pump to be mounted in any position without affecting its ability to prime or pump. The design allows assembly in one direction rather than continually reorienting the pump to perform various assembly operations.

Referring to FIGS. 4A and 4B, the air motor housing consists of two essentially identical cylindrical split shells comprised in part of air caps 18 and 35 which are bolted together end to end to form a pump housing. of the air motor valving is installed inside the shells. The structural ribbing in the cavity provides sufficient internal baffling to eliminate the need for an external muffler. The exhaust port is also threaded to provide means to pipe exhaust air to a remote location. The air motor also extends beyond the fluid cap housings to allow end cover plates 46, 47 to be attached inside the ends of the motor housings. The end plates cover the exposed fasteners, provide a "clean" look to the pump and displays labeled porting for fluid and air connections. The fluid and air connections for this design differ from the conventional diaphragm pump design in that the connections are made on the end of the pump (in-line with the diaphragm centerline as opposed to perpendicular). Fluid connections may be made on either end. The air is provided to air inlet 113 on one end only. This allows the pump to be installed in any axis in line with the plumbing system. It is particularly useful for applications where the pump must be inserted into a shaft or hole where fluid and air supply hoses cannot extend beyond the pump outside diameter.

Figure 1:
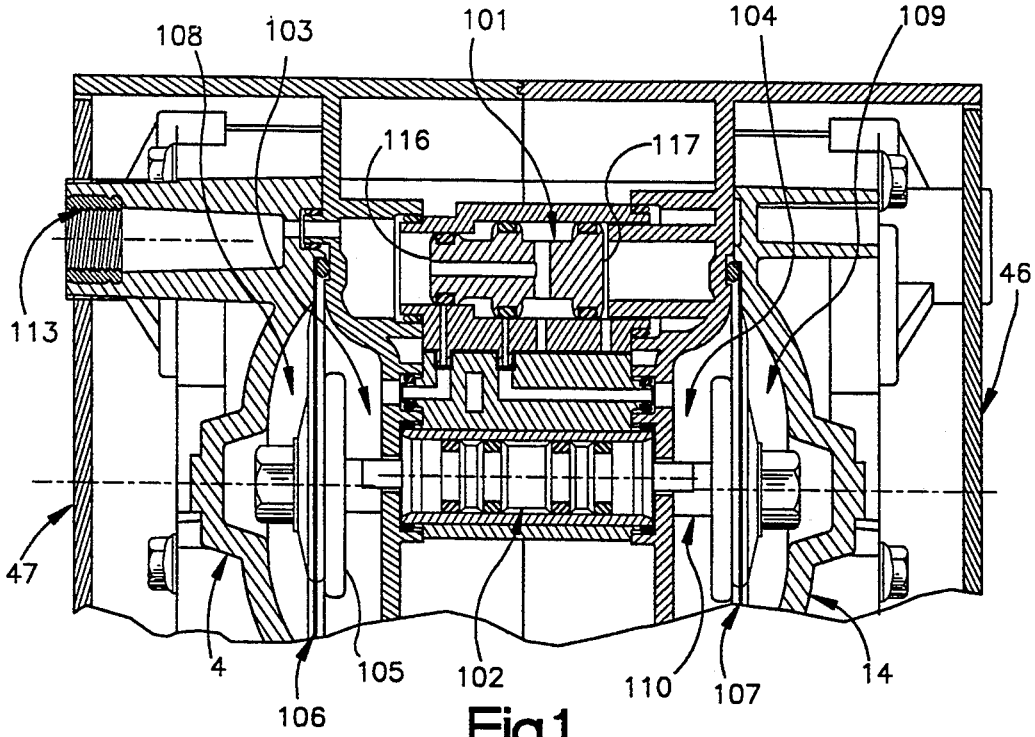
FIG. 1 is a partial cross section of an air operated double diaphragm pump according to the present invention taken at the longitudinal center of a substantially circular cross section showing the pilot valve in the center position.

Referring to FIG. 1, the pump is operated by supplying compressed air or gas to the air motor inlet port 113. The valving in the air motor senses position of the diaphragms and alternately pressurizes and exhausts the appropriate air chamber to cause the diaphragms to oscillate. The two diaphragms are connected by a rod so the two diaphragms move together resulting in a relatively constant fluid flow output. The motor consists of a spool valve 101 and pilot valve 102. The spool valve 101 connects air supply and exhaust ports to the appropriate diaphragm air chambers 103 and 104.

The spool valve is actuated by supplying air pressure to each end of the spool valve 101. Supply air pressure is applied via air inlet 113 to the small end 116 of the spool valve to hold the valve in one position (to the right). To shift the spool to the left, a pilot signal is applied to the large end 117. Since the area of the large end is approximately twice the area of the small end, applying equal air pressure to both ends will cause the spool to shift to the left as viewed in FIG. 1. The pilot valve 102 is a three way valve with an output port (not shown) connected to the spool valve 101. This provides an on or off pilot signal to the spool valve 101 depending on the pilot valve spool position. At the end of each pumping stroke the diaphragm backup washer 105 contacts the ends of the pilot valve which project into the chambers 103,104 and moves it to either pressurize or exhaust the large end 117 of the spool 101 valve. When the spool valve 101 shifts, the diaphragms 106,107 reverses direction to begin another pumping stroke. The pumping section consists of two pumping chambers 108 and 109. The chambers are separated from air chambers 103 and 104 by a flexible membrane 106 and 107. The membranes or diaphragms are connected to each other by a diaphragm rod 110.

Figure 3:
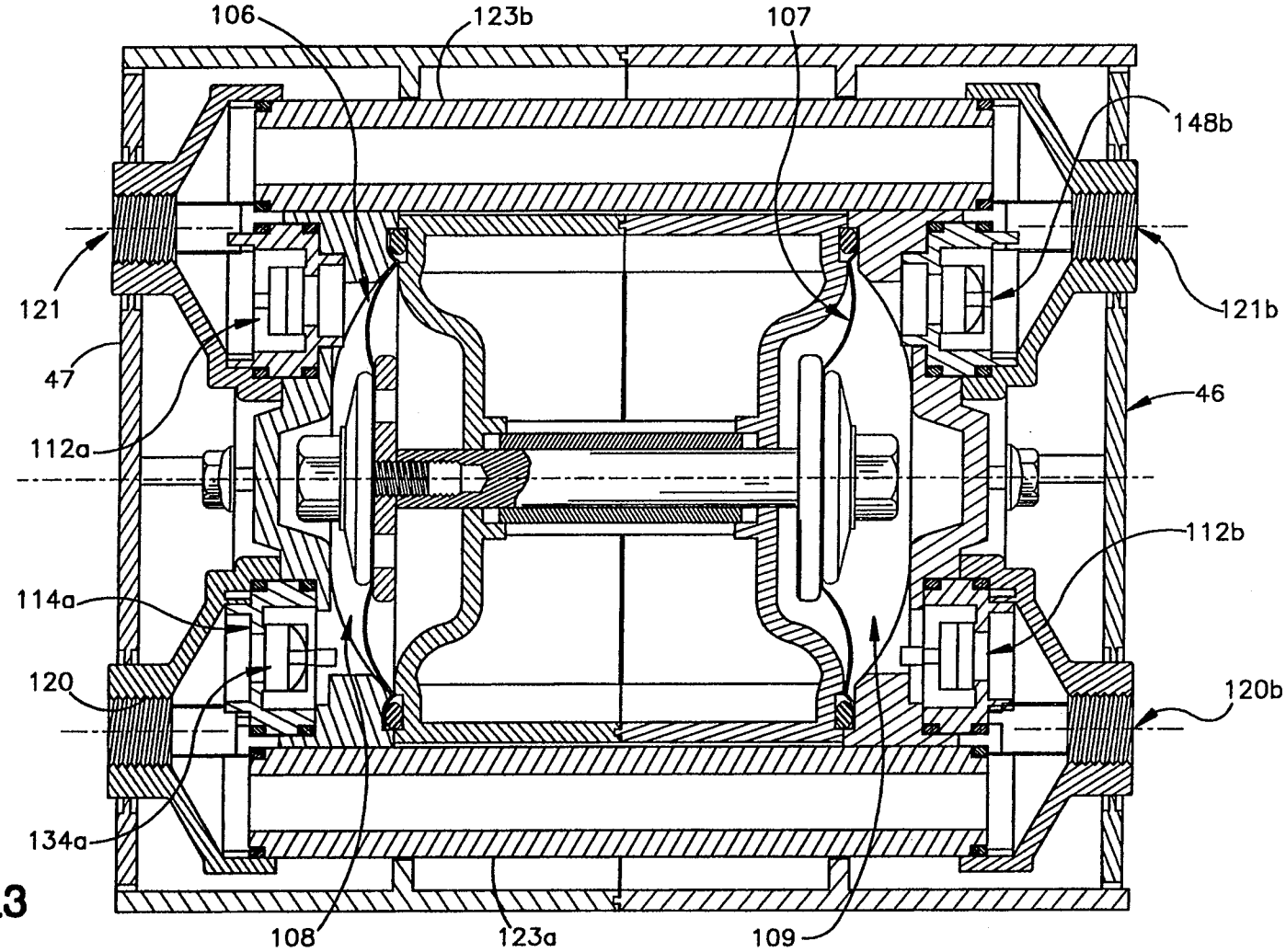
FIG. 3 is a cross section of an air operated double diaphragm pump according to the present invention taken at a longitudinal cross section approximately 90 degrees from that shown in FIGS. 1, 2, and 5.

Referring now to FIG. 3, material flow into and out of the pumping chambers 108, 109 is controlled by two one-way check valves positioned in each fluid chamber housing. One check 112A or 112B allows material to flow into the chamber (inlet check) on the suction stroke while the other check 114A or 114B (outlet check) prevents material from flowing back into the chamber from the pump outlet. When the pump reverses direction to displace the material, the inlet check 112A or 112B closes and the outlet check 114A or 114B opens allowing material to flow out of the pumping chamber.

The design allows customer selected inlet/outlet positions. There are two inlets 120A and 120B and two outlets 121A and 121B available. One each (inlet and outlet) or any combination of inlet or outlet may be used depending on the application. This is accomplished by plugging an unused inlet or outlet and selecting an appropriate hollow or solid internal replaceable manifold tube 123A or 123B as provided in the design. The pump may also be converted to a dual inlet/outlet configuration by substituting a solid rod for one or both manifold tubes 123A or 123B. This allows the pump to be configured as a single inlet/dual outlet; dual inlet/single outlet or dual inlet/dual outlet. This allows the pump to be used as two single acting pumps to pump two different materials or mix two different materials, etc.

PUMP OPERATION

Figure 2:
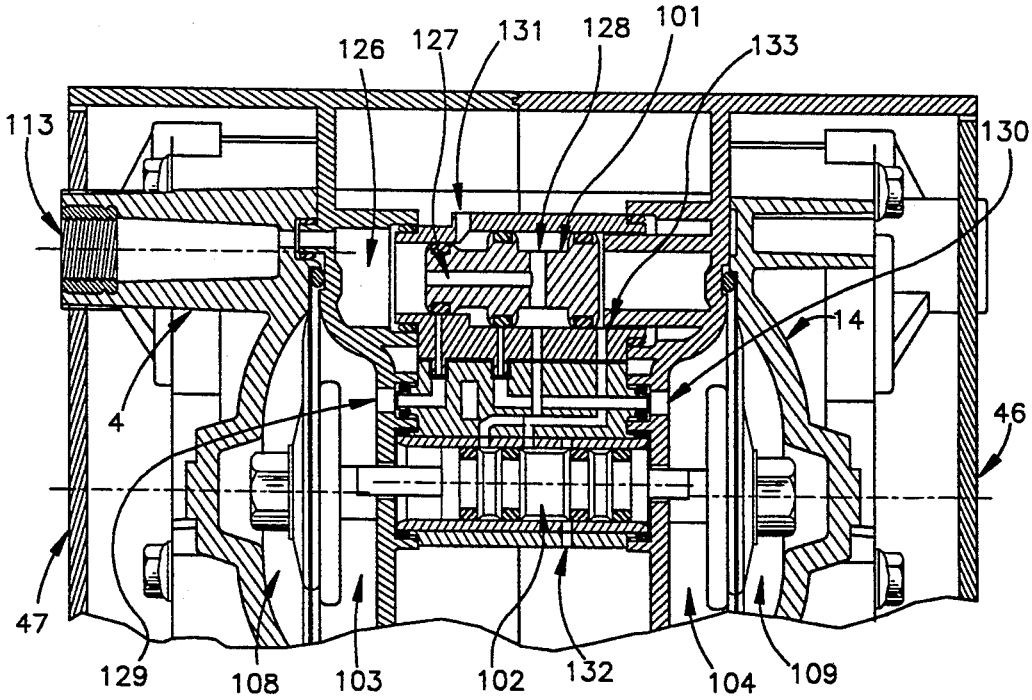
FIG. 2 is a partial cross section of an air operated double diaphragm pump according to the present invention taken at the longitudinal center of a substantially circular cross section showing the pilot valve in the extreme right hand position.

Compressed gas is supplied to port 113 which pressurizes chamber 126. The pressure acts on the small diameter 116 of spool 101 forcing it to the right as shown in FIG. 2. The gas also pressurizes longitudinal port 127, cross port 128, and chamber port 129. Air chamber 103 is pressurized through chamber port 129. At the same time air chamber 104 is exhausted to atmosphere through longitudinal exhaust port 130 and exhaust port 31. Pilot valve piston 102 is shown to its extreme right position. It is held in position by the air pressure in chamber 103 acting on the full diameter of the pilot piston 102. Cross exhaust port 133 from the large end of spool 101 is connected to atmosphere through exhaust port 132.

Compressed gas or air acts on diaphragm 106 (see FIG. 3) forcing it to the left since the air side of diaphragm 107 is connected to exhaust as shown in FIG. 3. As diaphragm 106 moves, it displaces fluid from pumping chamber 108 through check valve 112A into manifold outlet 121A. Check valve 114A is closed when fluid forces disc 134A against the seat as fluid tries to flow through the check. Since the two diaphragms 106, 107 move together, diaphragm 107 is creating a vacuum in chamber 109. Fluid flows from the pump material inlet 120B through inlet check 112B into pump chamber 109. The outlet check 114B closes to prevent material from flowing back into the pump chamber from the material outlet 121B.

As the diaphragms approach the end of the stroke, backup washer 135 (FIG. 5) contacts the extension of pilot valve 102 and pushes it to the position shown in FIG. 5. In this position exhaust port 132 is closed, ports 136 and 137 are connected. Port 136 is connected to the input supply air. This allows supply air to flow to chamber 138. The pressure acts on the large diameter 117 of spool 101 forcing it to the left. In this position the air in diaphragm air chamber 103 is exhausted through exhaust port 141 and 142. Diaphragm air chamber 104 is pressurized through port 140. Air pressure acting on diaphragm 107 causes the diaphragms to switch direction which reverses the action from left to right taking place within the pumping chambers as described above. When the diaphragms near the end of the stroke, backup washer 105 pushes pilot valve piston 102 to the right side position shown in FIG. 2. This causes the spool valve 101 to shift back to the right as shown in FIG. 2 to begin a new cycle.

DESCRIPTION OF ASSEMBLY

FIGS. 4A and 4B are an exploded view of the pump. Assembly begins by placing six nuts 1 into an assembly fixture (not shown). O-rings 2 are placed on check valve cartridges 3 (four required). The cartridges are made up of seat 7, disc 8 and spring stop 9. Spring stop 9 is held in seat 7 through an interference fit. The cartridges 3 are inserted into fluid cap 4. Alignment pins on the seats assure correct orientation. Manifolds 6 are placed over the cartridges and fluid cap. Frictional fit between the O-rings, manifold and fluid cap retains the parts and allows the assembly to be placed into the assembly fixture with the manifolds locating inside the fixture.

The diaphragm assembly is made up of a diaphragm nut 10, diaphragm 106, 107 and backup washer 105, 135. Two diaphragm assemblies are required. The diaphragm 16 assembly is placed into groove 13 of fluid cap 4. This groove is identical to the groove on fluid cap 14. O-ring 15 is placed in a groove on the O.D. of diaphragm assembly 16.

U-cup 17 are inserted lips first into the center bore of the air cap 35. Air cap 35 is then placed over fluid cap 4. Diaphragm rod 110 is inserted through U-cup 17 and threaded onto the threaded stud on diaphragm assembly 16. Rod 110 is next bottomed out against the assembly. Bushing 20 is slid over rod 19. Seal 21 is inserted into groove of air cap 18. O-rings 22, 23, and U-cup 24 are installed on spool 101 and O-rings 26 (4 required) are installed on pilot rod 102.

The process of assembly continues by inserting spool 101 into valve block 28 and pilot rod 102 into minor valve block 29. Gasket 30 is installed on valve block 28. Mating surfaces of minor valve block 29 and valve block 28 are aligned and the parts pressed together. O-rings 31 and 32 are installed to valve block 28, and O-rings 33 and 34 installed to minor valve block 29. Next, the valve block assembly is inserted into the mating bores of air cap 35. U-cup 51 is then inserted lips first into air cap 18. Air cap 35 is then set in place on air cap 18.

Alignment pins 37 assure proper orientation and alignment of caps and valve block assembly. O-Rings 50 are installed into air cap 18. Place O-ring 38 into groove of air cap 18. The groove is identical to groove 39 shown in air cap 35. Thread and bottom out diaphragm assembly 40 onto diaphragm rod 19. Continuing, place fluid cap 14 over diaphragm assembly. Next, install the cartridge assemblies 3 with O-rings 2 previously installed into the bores in fluid cap 14. Alignment pins insure proper orientation. The next step is to install O-rings 41 onto manifold tubes 123A, 123B, and insert the tubes 123A, 123B through the notches 43 in fluid cap 14 and into manifolds 6. Thereafter, place manifolds 44 over cartridges 3 and tubes 123A, 123B. Six bolts 45 are then inserted and torqued evenly. Final assembly begins by aligning the holes in the cover plate 46 with manifolds 44 and fluid cap bosses and press in place. Next, remove the pump from the assembly fixture and rotate the pump end for end to expose the opposite end of the pump. Finally, align the holes in cover 47 with the manifold 6 and press in place. Assembly is now completed.

What is claimed is:

1. A double diaphragm pump construction comprising:

a substantially cylindrical transverse split shell each of;

end cover plates disposed at each end of said shell; each of said end plates being further provided with both inlet and outlet pumped fluid connections so as to provide inline piping connection capability; and said pumped fluid connections of the end cover plates are selectively interconnected by replaceable and internal manifold tubes within said shell housing.

2. A double diaphragm pump construction according to claim 1, wherein at least one of said end cover plates is provided with a pressure fluid supply inlet.

3. A double diaphragm pump construction according to claim 1, wherein at least one of said end cover plates is provided with an exhaust outlet for pressure fluid.

4. A double diaphragm pump construction according to claim 1, wherein said shell further comprises passageways forming a muffler communicating with a pressure fluid exhaust in at least one of said end cover plates.

5. A double diaphragm pump construction according to claim 1, wherein said internal manifold further comprises in part a manifold tube interconnecting pumped material inlet ports on both ends of said shell and pumped material outlet ports on both ends of said shell.

6. The manifold tubes according to claim 5, wherein said manifold tubes are alternatively solid spacers.

7. A double diaphragm pump construction according to claim 1, wherein said split shell further comprises means for mounting said pump.

* * * * *